US011890712B2

(12) United States Patent
Schneider et al.

(10) Patent No.: US 11,890,712 B2
(45) Date of Patent: Feb. 6, 2024

(54) TOOL, DEVICE, AND METHOD FOR POLISHING LENSES

(71) Applicant: SCHNEIDER GMBH & CO. KG, Fronhausen (DE)

(72) Inventors: Gunter Schneider, Marburg (DE); Stephan Huttenhuis, Niederweimar (DE); Andreas Fedoseew, Giessen (DE); Nadine Geist, Solms (DE)

(73) Assignee: SCHNEIDER GMBH & CO. KG, Fronhausen (DE)

( * ) Notice: Subject to any disclaimer, the term of this patent is extended or adjusted under 35 U.S.C. 154(b) by 1116 days.

(21) Appl. No.: 16/307,174

(22) PCT Filed: Jun. 2, 2017

(86) PCT No.: PCT/EP2017/025160
§ 371 (c)(1),
(2) Date: Dec. 5, 2018

(87) PCT Pub. No.: WO2017/211467
PCT Pub. Date: Dec. 14, 2017

(65) Prior Publication Data

US 2019/0126425 A1 May 2, 2019

(30) Foreign Application Priority Data

Jun. 6, 2016 (DE) ..... 10 2016 006 741.1

(51) Int. Cl.
*B24B 13/01* (2006.01)
*B24B 13/02* (2006.01)
(Continued)

(52) U.S. Cl.
CPC ..... *B24B 13/01* (2013.01); *B24B 9/14* (2013.01); *B24B 13/012* (2013.01); *B24B 13/02* (2013.01); *B24B 13/06* (2013.01)

(58) Field of Classification Search
CPC ..... B24B 13/0006; B24B 13/0012; B24B 13/0018; B24B 13/0025; B24B 13/01;
(Continued)

(56) References Cited

U.S. PATENT DOCUMENTS 3,430,391 A * 3/1969 Borish ..... B24B 13/0025 351/159.75
4,979,337 A * 12/1990 Duppstadt ..... B24B 13/01 451/550
(Continued)

FOREIGN PATENT DOCUMENTS

DE 10031057 B4 4/2005
JP H0985603 A 3/1997
(Continued)

*Primary Examiner* — Eileen P Morgan
(74) *Attorney, Agent, or Firm* — David S. Safran; Calderon Safran & Cole P.C.

(57) ABSTRACT

A tool, a device, and a method for zonal polishing of optical workpieces, wherein the tool has a preformed cap for forming a polishing surface, and the tool is placed against the workpiece that is to be polished in such a way that the tilt angle of the axis of rotation of the tool to the normal of the contact surface on the workpiece remains at least essentially constant and/or the size of the contact surface remains at least essentially constant.

15 Claims, 3 Drawing Sheets

(51) Int. Cl.
*B24B 13/06* (2006.01)
*B24B 9/14* (2006.01)

(58) Field of Classification Search
CPC ..... B24B 13/012; B24B 13/02; B24B 13/06; B24B 7/241; B24B 9/14
USPC ... 451/9, 10, 11, 42, 59, 236, 255, 256, 280, 451/283, 285, 287, 290, 384, 390, 495, 451/514, 516, 921
See application file for complete search history.

(56) References Cited

U.S. PATENT DOCUMENTS 4,989,316 A 2/1991 Ogan et al.
5,320,006 A 6/1994 Blocha et al.
5,577,950 A * 11/1996 Smith ..... B24B 13/012 451/384
6,796,877 B1 * 9/2004 Bingham ..... B24D 13/20 451/900
6,814,650 B2 11/2004 Bernard et al.
7,312,154 B2 * 12/2007 Cites ..... H01L 21/30625 438/692
7,413,503 B2 * 8/2008 Tabata ..... B24B 13/02 451/274
7,854,645 B2 12/2010 Kiontke et al.
8,062,098 B2 * 11/2011 Duescher ..... B24B 37/14 451/550
8,727,834 B2 5/2014 Schneider et al.
10,569,387 B2 * 2/2020 Philipps ..... B24B 13/012
11,358,250 B2 * 6/2022 Kojima ..... B24B 13/02
2002/0160690 A1 * 10/2002 Miyazawa ..... B24B 1/00 451/5
2003/0045211 A1 * 3/2003 Kuebler ..... B24B 41/04 451/24
2004/0048555 A1 * 3/2004 Jinbo ..... B24B 57/02 451/6
2004/0229553 A1 * 11/2004 Bechtold ..... B24B 13/01 451/42
2006/0099889 A1 * 5/2006 Tabata ..... B24B 13/02 451/41
2008/0149269 A1 * 6/2008 Suzuki ..... B24B 9/14 428/131
2013/0052918 A1 * 2/2013 Yajima ..... B24B 13/02 451/42
2013/0244553 A1 9/2013 Tuecks
2015/0050864 A1 * 2/2015 Stahringer ..... B24B 13/01 451/42
2017/0080542 A1 * 3/2017 Horikoshi ..... B24B 13/01
2017/0246729 A1 * 8/2017 Philipps ..... B24D 13/147
2017/0274491 A1 * 9/2017 Mukaiyama ..... B24B 13/02
2021/0016410 A1 * 1/2021 Geist ..... B24B 13/02

FOREIGN PATENT DOCUMENTS

JP 2000071154 A 3/2000
JP 2001263101 9/2001
JP 2002154040 A 5/2002
JP 5809816 B2 11/2015

* cited by examiner

TOOL, DEVICE, AND METHOD FOR POLISHING LENSES

FIELD OF THE INVENTION

This invention relates to a tool for preferably zonal polishing of optical workpieces, in particular lenses, with a curved head and an elastic cap arranged thereon to form a polishing surface, a device for preferably zonal polishing of optical workpieces, in particular lenses, with a tool spindle for rotating a tool and with a workpiece drive for rotating a workpiece that is to be polished, and a method for preferably zonal polishing of an in particular aspherical surface of an optical workpiece, in particular a lens, especially a method using the tool and device of the invention.

This invention deals in particular with the zonal polishing of optical workpieces. The tool (polishing tool) has a polishing surface that is placed or can be placed only partially at the area of a contact surface against the workpiece that is to be polished. This contact surface is significantly smaller in comparison to the overall surface of the workpiece that is to be polished, in particular compared to the radial extension of the workpiece. In terms of this invention, "zonal" is to be understood in particular only as polishing with such a "small" contact surface. In contrast, so-called cup tools extend with their contact surface or their contact edge over the entire radius of a workpiece surface that is to be polished.

With the proposed zonal polishing, in particular polishing of aspherical and/or free-formed surfaces and/or workpieces is also possible.

DESCRIPTION OF THE RELATED ART

For zonal polishing, in particular mushroom-head-shaped polishing tools are used, wherein a curved head of the tool carries a flexible or elastic polishing element for forming a curved polishing surface. European Patent Application EP 1 796 872 B1 and corresponding U.S. Patent Application Publication US 2007173176 A1 show an example of such a tool. During polishing, the polishing surface of the tool abuts partially in the area of its contact surface on the workpiece, wherein here the tilt angle between the surface normal of the contact surface and the axis of rotation of the tool is continuously changed so that the contact surface on the tool migrates along a degree of longitude.

The zonal polishing is used in particular for precision optics or workpieces with aspherical surfaces, for example for mirrors or in particular lenses, and in particular for correcting errors in production. Consequently, it is important to make possible processing that is as exact or defined as possible. During polishing, namely a certain material removal on the workpiece always takes place.

German Patent Application DE 10 2004 047 563 A1 and corresponding U.S. Pat. No. 7,854,645 B2 disclose a method for polishing a rotating workpiece with a tool that has a rubber membrane or a ram with a bonded polyurethane membrane. The exact structure of the tool is not discussed in any greater detail.

SUMMARY OF THE INVENTION

The object of this invention is to indicate a tool, a device and a method as well as a use for in particular zonal polishing of optical workpieces, wherein an especially exact and/or defined polishing of the respective workpiece, in particular also an aspherical surface, with preferably simple structure is made possible.

The above-mentioned object is achieved by a tool, a device, and a method as described herein.

According to a first aspect of this invention, the tool has an elastic cap for forming a polishing surface or a polishing pad, preferably wherein the cap is preformed and/or shape-processed for shape-adapting to the curvature of a curved head of the tool and/or sits or is on the head stress-free. An especially defined springing behavior of the cap or the polishing surface formed therefrom can be achieved in a simple way. In particular, namely by the preforming or shape-processing before the affixing or bonding of the cap onto the tool head it can be achieved that, in most cases undefined, deformations, stresses and the like that occur in the cap material, which occur otherwise in the adaptation to the curvature, are avoided or at least minimized.

Preferably, the cap is built up of multiple layers and has in particular an intermediate element and a polishing element. This is conducive to achieving the desired properties, in particular with respect to the springing behavior, the abrasion behavior, and the polishing behavior.

In particular, the polishing element forms a polishing pad or a polishing film or polishing layer.

In the case of this invention, in general the polishing surface or the polishing pad that is formed by the cap or the polishing element preferably forms a polishing agent carrier for a polishing agent. The proposed polishing relates to the polishing with a polishing agent, which is present or is used in particular in the form of a suspension with polishing particles, such as finest granules, particles, or the like. The polishing surface in particular serves also to transport the polishing agent into an active gap between the contact surface of the tool and the surface that is to be polished and/or to distribute or to move said polishing agent therein and/or to rub with the polishing agent on the surface.

In particular, the roughness of the surface is reduced by the polishing, and/or the cracks in the material that develop in the case of a preceding shaping, for example by grinding, can be removed. Here, material is stripped off each time. The stripped-off material is also conveyed away from the active gap between the polishing surface and the surface that is to be polished by the tool or the polishing surface by means of the polishing agent.

In general, this invention thus relates in particular to the polishing of a workpiece using a tool and a polishing agent. However, the polishing can be done alternatively even without a separate or additional polishing agent, but rather only with the tool.

Depending on the polishing agent, the polishing surface is made porous or non-porous as desired and/or is provided with a favorable surface structure or texture in order to achieve the desired polishing effect in particular with a certain polishing agent at the respective workpiece material.

Preferably, the intermediate element and also the polishing element are preformed or shape-processed for adapting the shape to the curvature. The polishing element is then adapted to the shape of the intermediate element by prior shaping. Thus, stresses between the two elements can also be avoided or at least minimized.

The preforming can be done, for example, by corresponding foaming or other primary forming with the desired shape.

The shape-processing is done preferably by material removal and/or mechanical processing of the cap or the elements that form the cap, in particular by milling and/or turning, for example from sheet material or solid material.

The polishing element is preferably designed significantly thinner than the intermediate element.

Preferably, the cap is—or the intermediate element and the polishing element are—bonded. This allows for a simple structure.

Especially preferably, the tool has a collar or other stop in the area of the head for support on the peripheral side and/or positioning of the cap. This is conducive to a simple and defined production.

According to a second, also independently-achievable aspect of this invention, a proposed device and a proposed method are distinguished in particular in that the diameter of the contact surface of the tool at the workpiece and/or the tilt angle of the axis of rotation of the tool to the normal (surface normal) of the contact surface is or are kept at least essentially constant during the polishing of the workpiece, i.e., during the respective polishing process. This is conducive to a defined polishing with in particular defined material removal.

According to a third, also independently-achievable aspect of this invention, the proposed device and the proposed method are distinguished in particular in that the tool is moved or movable from an edge of a surface of the workpiece that is to be polished over the center up to the opposite side of the edge. In this way, an especially uniform polishing is made possible, in particular also in the area of the optically important and sensitive center of the workpiece. The usual stopping or termination of the polishing process in the area of the center in most cases namely leads to uneven and/or undefined material removal.

According to a fourth, also independently-achievable aspect of this invention, the indentation depth of the in particular elastically-deformable polishing surface on the tool is preferably varied, controlled or feedback controlled by corresponding advancing of the tool relative to the workpiece during the polishing process, especially preferably depending on the radial position of the contact surface on the workpiece, the desired diameter of the contact surface, the (desired) contact pressure of the tool on the workpiece, and/or the profile of the workpiece, in particular the curvature of the workpiece in the area of the respective contact surface. This is conducive to a defined polishing and a defined material removal, wherein optimization of the time required for the polishing is also made possible.

According to a fifth, also independently-achievable aspect of this invention, the distance between adjacent tracks of the preferably spiral polishing path of the contact surface on the workpiece or the surface that is to be polished is optionally kept at least essentially constant. This is conducive to a defined polishing and/or a defined material removal.

According to a sixth, also independently-achievable aspect of this invention, the rotational speed of the workpiece is optionally varied or controlled or feedback controlled during a rotation depending on the rotating position, a locally desired dwell time (polishing time), the diameter of the contact surface, the contact pressure of the tool on the workpiece, and/or the profile of the workpiece, in particular in the area of the respective contact surface. In this way, taking into consideration the actual three-dimensional course of the surface that is to be polished, an optimal polishing with defined material removal and/or an influencing or control can also be achieved.

According to a seventh, also independently-achievable aspect of this invention, the tool is preferably provided with a polishing surface, which is formed from at least essentially closed pores, in particular wherein the polishing surface is formed to more than 1 or 5% (relative to the surface extension or pore number) by pores with a size of more than 0.5 mm and/or to more than 25 or 50% (relative to the surface extension or the pore number) from pores with a size of less than 0.4 or 0.3 mm, especially preferably less than 0.1 mm, and/or in particular wherein the size of the pores on the polishing surface is less than 1 mm, in particular less than 0.9 mm, and/or in particular wherein the polishing surface is not processed mechanically or is not trued off. In particular, the average or maximum diameter is viewed as the size of the pores. Tests have shown that such a polishing surface has especially good polishing properties, in particular in the polishing of precision optics or glass.

Especially preferably, the polishing surface or the polishing pad or cap that forms the latter is produced from polyurethane or another suitable foam or plastic.

Preferably, the tool is used for zonal polishing and/or is produced and prepared for the device for polishing; a (another) conditioning or trimming of the polishing tool, as is usual in particular in the case of precision processing, is thus not (anymore) necessary.

Especially preferably, the workpiece that is to be polished is first calibrated, and errors can then be corrected by correction polishing with the proposed tool, the proposed device, and/or the proposed method.

The proposed tool, the proposed device, and/or the proposed method can be used in particular for pre-polishing and/or correction polishing.

The above-mentioned and subsequent aspects and features of this invention can be combined with one another as desired but also can be implemented in each case independently of one another.

Additional aspects, features, advantages and properties of this invention will be apparent from the following description of a preferred embodiment in connection with the accompanying drawings.

BRIEF DESCRIPTION OF THE DRAWINGS

Figure 1:
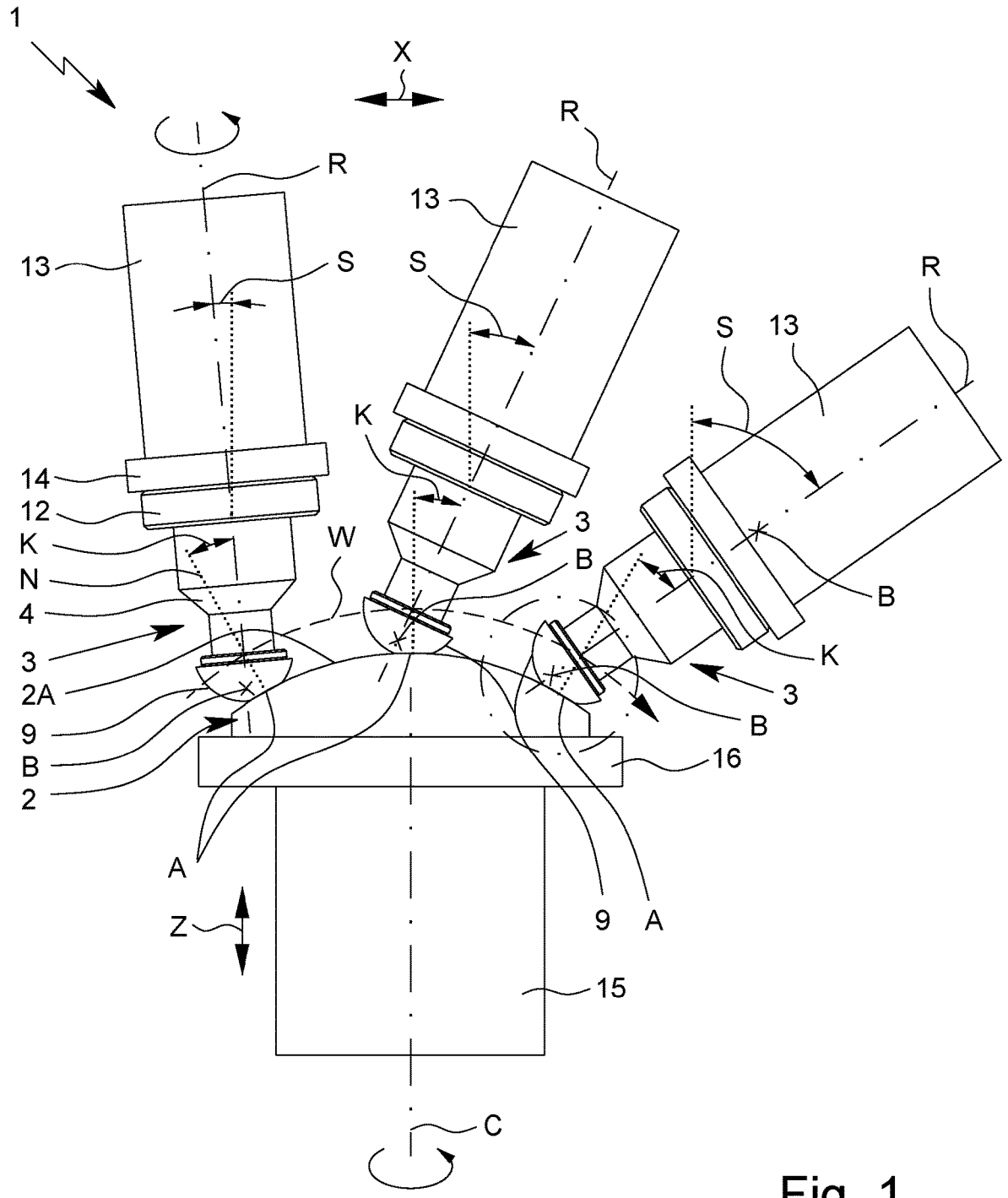
FIG. 1 is a diagrammatic depiction of a proposed device for polishing an optical workpiece, wherein different positions of a proposed tool with assigned tool spindles are depicted.

In a schematic depiction, FIG. 1 shows a proposed device 1 for zonal polishing of an optical workpiece 2, in particular a lens, a mirror or the like, especially preferably made of glass.

The device 1 is designed for polishing the workpiece 2 by means of a proposed tool 3 or another tool. The preferred design of the proposed polishing tool 3 is in particular explained in more detail based on FIG. 2.

In the depiction according to FIG. 1, the tool 3 together with an assigned tool spindle 13 of the device 1 is depicted in three different positions to illustrate the movability of the tool 3 or a preferred process sequence.

Figure 2:
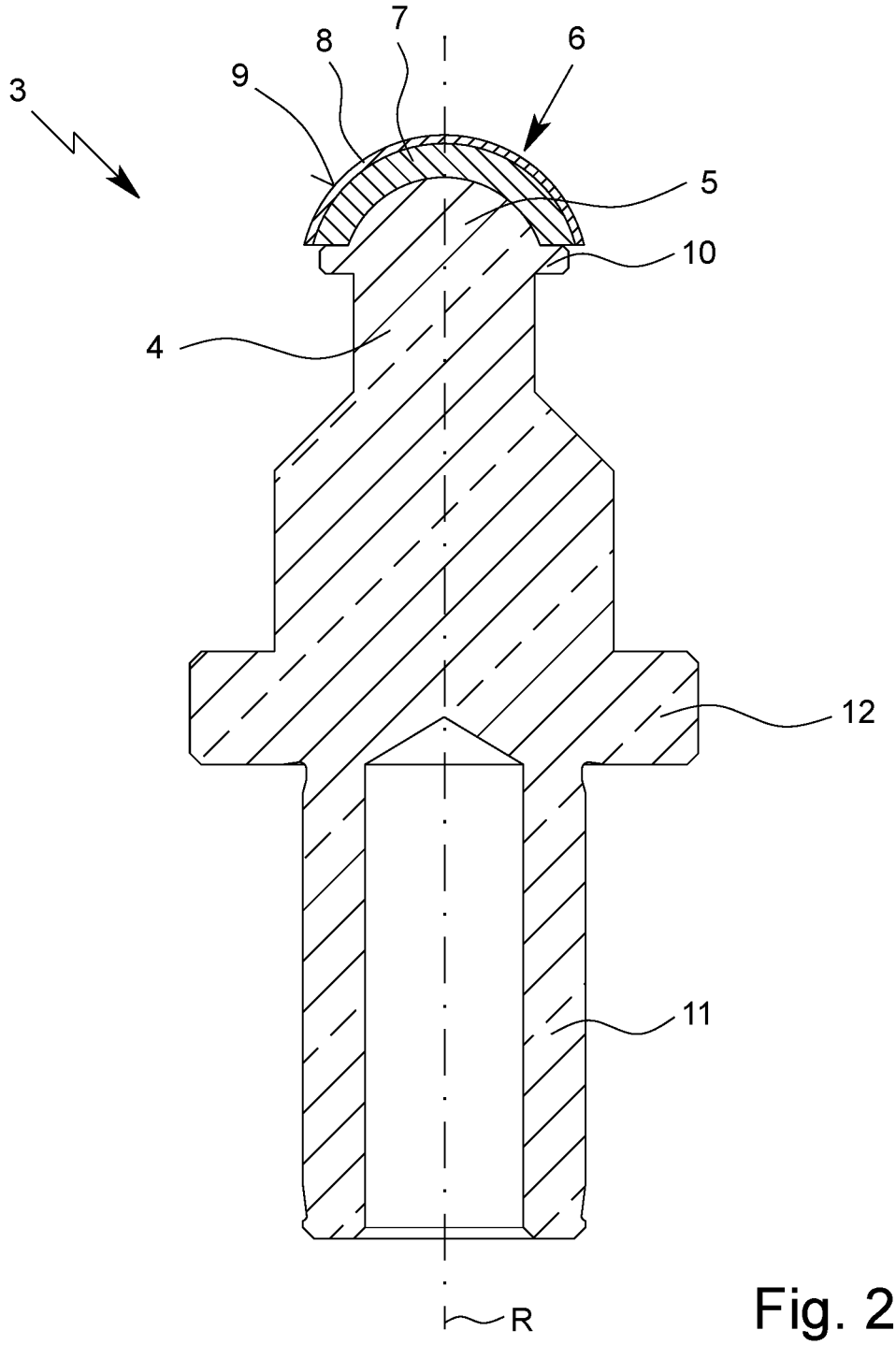
FIG. 2 is a schematic sectional view of the proposed tool.

The proposed tool 3 is depicted in a schematic section in FIG. 2. It preferably has a carrier 4 with a curved head 5 as well as a hemispherical or cone-shaped cap 6.

The cap 6 is preferably built up of multiple layers and in the illustrative example preferably has an intermediate element 7 and a polishing element 8.

The tool 3, the cap 6 or the intermediate element 7 thereof is attached to the head 5 of the tool 3, in particular bonded to said head.

The cap 6 or the polishing element 8 thereof forms a polishing surface 9.

The polishing surface 9 of the tool 3 or the cap 6 or the element 8 is preferably curved in a convex manner, in particular curved geometrically similar to the head 5 or matched thereto and/or designed preferably has a spherical, hemispheric and/or conic shape.

The polishing element 8 is attached to the intermediate element 7, in particular bonded to the latter.

As an alternative, however, the cap 6 can also be formed in one piece and/or produced in multiple layers by bi-injection or the like.

The cap 6 and/or the intermediate element 7 and/or the polishing element 8 is or are produced preferably from plastic or foamed material and/or from an elastic and/or flexible material.

Especially preferably, the intermediate element 7 is produced from a preferably closed-cell foam, in particular from polyurethane.

The cap 6 and/or the intermediate element 7 preferably has a static modulus of elasticity of more than 0.5 $N/mm^2$, preferably more than 1 $N/mm^2$, in particular more than 1.5 $N/mm^2$, and/or less than 30 $N/mm^2$, preferably less than 15 $N/mm^2$, in particular less than 7.0 $N/mm^2$, at a static permanent load; and/or a dynamic modulus of elasticity of more than 0.5 $N/mm^2$, preferably more than 1 $N/mm^2$, in particular more than 1.3 $N/mm^2$, and/or less than 20 $N/mm^2$, preferably less than 10 $N/mm^2$, in particular less than 8.0 $N/mm^2$, at a dynamic permanent load of 10 Hz; and/or a compression hardness of more than 0.05 $N/mm^2$, preferably more than 0.1 $N/mm^2$, in particular more than 0.2 $N/mm^2$, and/or less than 3 $N/mm^2$, preferably less than 2 $N/mm^2$, in particular less than 1 $N/mm^2$, at 10% deformation, in each case in particular measured according to DIN 53513:1990-03.

The polishing element 8 is preferably produced from a harder and/or stiffer material than the intermediate element 7.

The polishing element 8 is preferably thin-walled and/or film-like.

The bulk density—preferably according to DIN EN ISO 845:2009-10—of the polishing element 8 is preferably more than 300 $kg/m^3$, in particular more than 500 $kg/m^3$, especially preferably more than 700 $kg/m^3$, and/or preferably less than 4,000 $kg/m^3$, in particular less than 3,000 $kg/m^3$, especially preferably less than 2,000 $kg/m^3$.

The polishing element 8 or the cap 6 or polishing surface 9 preferably has a Shore A hardness of more than 5, in particular more than 10, especially preferably more than 20, and/or preferably less than 90, in particular less than 80, especially preferably less than 70, in particular according to DIN ISO EN 868:2003-10 and/or DIN ISO 7619-1:2012-02.

The polishing element 8 preferably has a thickness of more than 0.1 mm, in particular more than 0.3 mm, especially preferably more than 0.4 mm, and/or preferably less than 3 mm, in particular less than 2 mm, especially preferably less than 1 mm.

The thickness of the intermediate element 7 is preferably more than 2 mm and/or less than 10 mm, in particular approximately 3 to 7 mm.

The thickness of the intermediate element 7 is preferably at least 5 times, in particular approximately 10 times, the thickness of the polishing element 8 or more.

The cap 6, the intermediate element 7 and/or the polishing element 8 has or have preferably each an at least essentially constant thickness.

The polishing element 8 or the polishing surface 9 is preferably formed or produced from an open-cell or closed-cell plastic or composite material or the like.

In the illustrative example, the polishing element 8 is preferably produced from a plastic film and/or from polyurethane.

The cap 6 and/or the intermediate element 7 and/or polishing element 8 is or are preformed or shape-processed to adapt the shape to the curvature of the head 5 and/or to achieve a desired curvature or other shape, such as a spherical shape, preferably inside and/or outside, thus, adapted in its/their shape to the head 5 before being affixed on the tool 3 or head 5, provided in particular with a complementary curvature to the head 5 and/or intermediate element 7.

The tool 3 and/or the head 5 preferably forms a solid or non-flexible surface made of metal or another suitable material for supporting and in particular also fastening the cap 6 and/or elements 7, 8 arranged thereon.

The shaping or shape-processing of the cap 6 and/or the intermediate element 7 and/or polishing element 8 is done especially preferably mechanically, in particular by turning and/or milling.

Especially preferably, solid material is mechanically processed for the desired shaping.

The mechanical processing has the advantage that a very uniform material layer without material compression, deformation or other material irregularities can be produced with the desired shape, here in particular a cap-like or spherical shape, if desired also with another shape.

As an alternative, the above-mentioned shaping can be carried out, for example, also by corresponding foaming or other primary forming.

The preformed and/or shape-processed cap 6 or correspondingly preformed or shape-processed elements 7 and 8 is or are applied on the tool 3 or head 5, in particular by bonding.

Especially preferably, the polishing element 8 is also applied on the intermediate element 7 by bonding. However, it can also be connected in another way.

Especially preferably, the cap 6 and/or the intermediate element 7 is or sits on the head 5 in a stress-free manner.

According to the invention, "stress-free" is to be understood in particular as no local material deformations or stresses occurring in the material of the cap 6 or elements 7, 8, in the attached state, by adapting to the curvature, which would develop due to deformation in adapting to the curved shape and which negatively influence a uniform and in particular defined springing and damping behavior of the cap 6 or elements 7, 8.

Preferably, in this sense, the polishing element 8 is also correspondingly to be affixed in a stress-free manner, in particular also to avoid possible folding.

Especially preferably, the polishing element 8 is adapted to the curvature of the outside of the intermediate element 7 by corresponding preforming, in particular shape-processing, before the affixing to or connection with the intermediate element 7.

The tool 3, the cap 6, the polishing element 8 and/or the polishing surface 9 is designed in particular in such a way that a polishing agent, not shown, is transported via the polishing surface 9 and thus the workpiece 2 can be processed in a mechanical-chemical removal process and thus can be polished as already described above.

To facilitate the affixing and/or positioning of the cap 6 and/or elements 7, 8, the tool 3 or its carrier 4 preferably has a collar 10 or other stop, which projects in particular laterally from the head 5 and/or forms a preferably circumferential shoulder or the like.

The tool 3 and/or the carrier 4 preferably has a connecting portion 11 and/or a stop 12 for defined fastening or holding of the tool 3 on the assigned tool spindle 13 or the tool chuck 14 thereof or the like.

Especially preferably, the tool 3 is clamped or fastened by means of the tool chuck 14 on the tool spindle 13. The stop 12 in this case serves in particular to ensure a defined axial position of the tool 3 on the tool spindle 13 or on the tool chuck 14. Other structural solutions are also possible, however.

Preferably, tools 3 with different radii of curvature of the head 5 or the cap 6 or the polishing surface 9 are used depending on the shape of the surface 2A that is to be polished.

The radius of curvature of the polishing surface 9 is preferably more than 2 mm, in particular more than 3 mm or 5 mm, and/or preferably less than 1,000 mm, in particular less than 500 mm, especially preferably less than 100 mm, preferably based on the (maximum) curvature of the surface 2A that is to be polished and/or the desired use. During correction polishing, namely tools 3 with smaller radii of curvature of preferably below 100 mm are used.

The distance from the polishing surface 9, in particular at the point of intersection with the axis of rotation R, to the stop 12 is preferably the same in all tools 3 even with varying curvature or bend.

The proposed device 1 has the tool spindle 13 for rotating the assigned or clamped tool 3 around an axis of rotation R, as indicated in FIG. 1.

The rotational speed is preferably approximately 1,000 to 5,000 rpm.

The rotational speed is preferably controlled or feedback controlled.

Preferably, the rotational speed during the polishing process is kept constant. However, in principle, a change in the rotational speed during a polishing process or an adaptation of the rotational speed to a respective tool 3 and/or workpiece 2 or for each polishing process is also possible.

The rotation of the tool 3 is done preferably without detecting the angle of rotation. This is thus in particular not a controlled axis of rotation in the sense of a CNC control.

The tool spindle 13 and thus the tool 3 can be swiveled around a swivel axis B. In particular, this is a controlled or feedback-controlled swivel axis or CNC axis, also called a rotary axis. In particular, the swiveling position is detected. Thus, a defined swiveling is made possible, as depicted by way of example by the three different positions in FIG. 1.

In the illustrative example, the swivel axis B runs crosswise and in particular perpendicular to the axis of rotation R or drawing plane.

The swivel axis B is preferably arranged as close as possible to the tool 3 or to the polishing surface 9 and/or to the tool chuck 14.

The device 1 has a workpiece drive 15, in particular a workpiece spindle, for the workpiece 2, so that the workpiece 2 that is to be polished can be rotated around the axis of rotation C with a defined angular position.

Preferably, the workpiece 2 is held by means of a holder 16, such as a block piece, and/or by means of a chuck on the workpiece drive 15 with a defined angular position or is coupled thereto.

The axis of rotation C is in particular a controlled or feedback-controlled axis or a CNC axis, also called a rotary axis. Preferably, here, the position of the angle of rotation is thus also detected. Especially preferably, an angle-dependent variation of the rotational speed is also made possible within a rotation.

The rotational speed of the workpiece drive 15 or the workpiece 2 is in general variable, in particular, for example, from approximately 10 or 20 rpm (for polishing on the edge 2C of the side 2A of the workpiece 2 that is to be polished) up to approximately 2,000 to 3,000 rpm (for polishing in the area of the center 2B of the workpiece 2).

The C-axis preferably runs in a plane with the axis of rotation R (independently from the swiveling position of the tool spindle 13) and/or crosswise or perpendicular to the swivel axis B.

The workpiece drive 15 and thus the workpiece 2 is preferably movable and/or adjustable linearly in the Z-direction, as indicated in FIG. 1. The adjustment is made in particular by means of a not shown slide and adjustment drive or the like.

The Z-axis preferably runs parallel to the C-axis and/or crosswise or perpendicular to the swivel axis B.

The tool spindle 13 and thus the tool 3 is preferably adjustable crosswise in the X-direction, in particular by means of a slide, not shown, and an assigned drive. This slide then preferably also carries the B-axis and the corresponding swivel drive for swiveling the tool spindle 13.

The X-axis and Z-axis are preferably each designed as a controlled or feedback-controlled axis or as a CNC axis or linear axis, so that an exact positioning in the X- and Z-direction is made possible.

The X-axis preferably runs crosswise or perpendicular to the C-axis, B-axis and/or Z-axis.

The X-axis preferably runs in—or parallel to—the common plane of the C-axis and R-axis.

The axes can also be stacked or distributed in a different way. For example, the Z-axis can be assigned to the tool spindle 13 instead of the workpiece drive 15. As an alternative or in addition, it is also possible that the B-axis and/or X-axis is/are not implemented on the tool side but rather on the workpiece side.

It is desirable, however, to distribute the axes on the tool side and workpiece side in order to make possible a greater processing accuracy.

The device 1 is in particular a polishing machine or CNC machine with X-, Z-, B- and C-axes.

The X-axis and/or the B-axis preferably run(s) horizontally.

Especially preferably, the C-axis and/or the Z-axis run(s) vertically.

Especially preferably, the polishing tools 3 are each located with their polishing surfaces 9 at the level of or near the B-axis, so that the contact surface A can be swiveled if possible with a minimum radius.

The B-axis is preferably spaced less than 100 or 50 mm, in particular less than 30 or 15 mm, especially preferably less than 10 mm, from the polishing surface 9 and/or contact surface A, in particular from the point of intersection between the axis of rotation R and the polishing surface 9. In particular, this distance is preferably at least essentially the same value even in the case of tools 3 with other radii of curvature of the polishing surface 9.

The B-axis intersects the axis of rotation R preferably inside the cap 6 and/or polishing surface 9.

Figure 3:
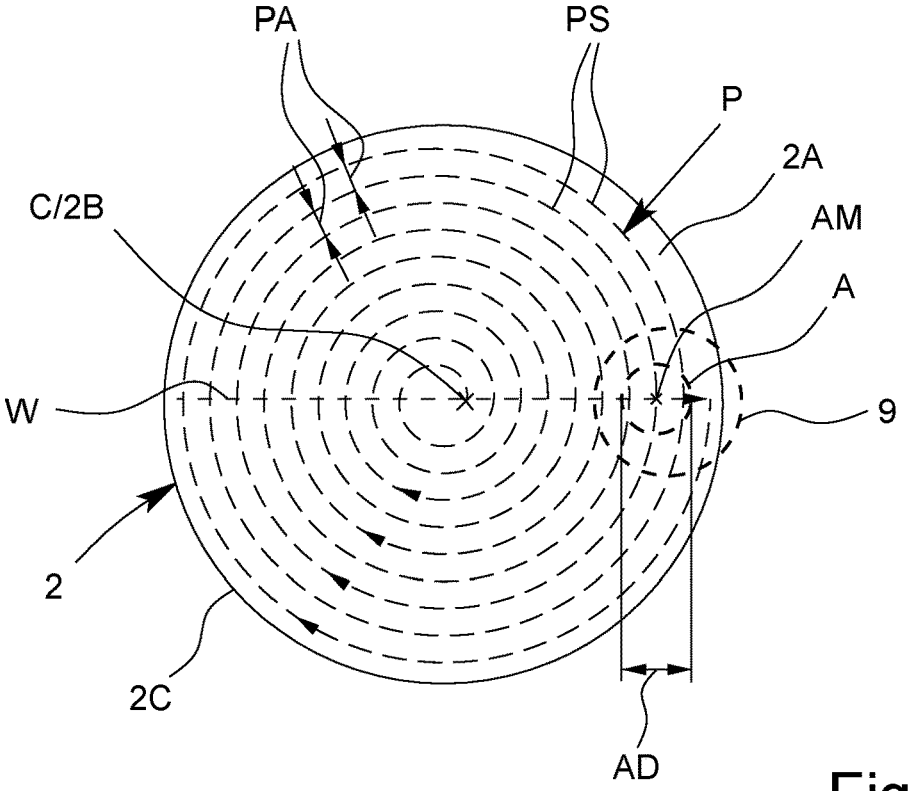
FIG. 3 is a schematic top view of a surface of the workpiece that is to be polished, wherein a contact surface of the tool and the polishing path traversed on the workpiece are schematically indicated.

By a corresponding relative adjustment, thus in particular by moving in the X- and Z-directions as well as by swiveling around the B-axis, the tool 3 can be moved over the workpiece 2 or the surface 2A that is to be polished in particular as schematically indicated by arrow W in FIG. 1 and in FIG. 3.

Especially preferably, the tool 3 is moved starting from an edge 2C of the workpiece 2 or the surface 2A to the center 2B and over the latter up to the opposite side of the edge 2C, as illustrated in FIGS. 1 and 3. In this manner, an interruption or ending of the polishing process in the area of the center 2B, as is common in the state of the art, is avoided, and thus more optimal processing and/or a more defined material removal is made possible or ensured.

Figure 4:
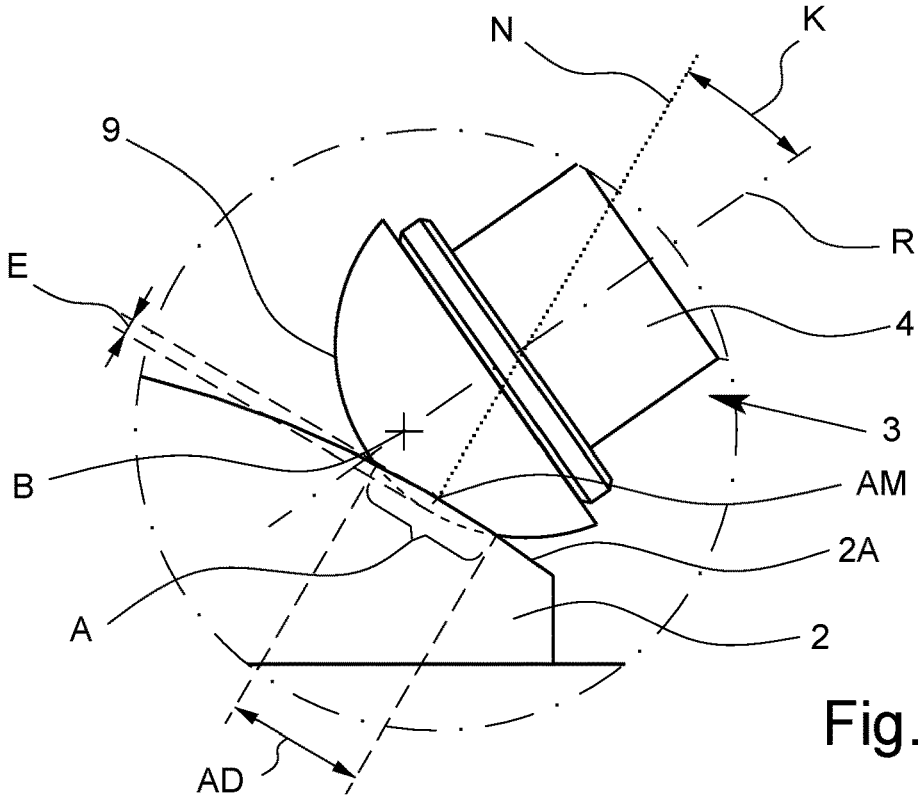
FIG. 4 is an enlarged view showing the tool head resting on the workpiece.

During polishing, the polishing surface 9 of the tool 3 abuts only section-wise with a contact surface A on the workpiece 2 that is to be polished or its surface 2A, as schematically depicted in particular also in FIG. 4, which depicts a sectional enlargement of the circular area of FIG. 1 indicated in dashed-dotted lines.

The contact surface A is preferably at least essentially circular, wherein this (also) depends on the three-dimensional shape of the surface 2A. In the schematic top view according to FIG. 3, the contact surface A, with which the polishing surface 9 lies against the workpiece 2 or the surface 2A thereof, is also indicated.

The surface normal N preferably intersects the axis of rotation R of the tool 3 under a (relative) tilt angle K, as indicated in FIGS. 1 and 4. In particular, polishing is carried out with the tool 3 in such a way that the contact surface A lies on the polishing surface 9 eccentrically with respect to the axis of rotation R. In other words, the processing or polishing is thus (preferably always) done at a tilt angle K of more than 0°, in particular more than 2°, especially preferably more than 5° or 10°, and/or preferably less than 50°, in particular less than 30°, especially preferably less than 25°.

Especially preferably, the tilt angle K is kept constant during the respective polishing process. This is achieved by corresponding swiveling of the tool spindle 13 or the tool 3. The pivoting angle S (angle of the axis of rotation R to the C-axis) then consequently varies along the tool path W, as indicated schematically in FIG. 1, for example from a small pivoting angle S in the left position to a medium pivoting angle S in the central position to a large pivoting angle S in the right position.

In terms of this invention, a polishing process in particular refers to the complete polishing of the surface 2A of the workpiece 2 that is to be polished with a tool 3. In such a process, as already explained, the tool path W is preferably traversed or run through by the tool 3, while on the one hand the tool 3 rotates and on the other hand the workpiece 2 rotates.

In the polishing process, the contact surface A or the center point AM thereof then sweeps over the surface 2A that is to be polished in an in particular spiral polishing path P, as only schematically indicated, however, in FIG. 3. The spiral polishing path P is namely traversed once, when the tool 3 or the contact surface A moves starting from the edge area 2C to the center 2B or to the axis of rotation C. The same or a corresponding spiral polishing path P is then traversed again, however, when the tool 3 or the contact surface A continues to move along the tool path W from the center 2B again back out to the edge area 2C.

Especially preferably, the device 1 is designed—or control or feedback control is done—in such a way that a uniform spiral or an at least essentially constant distance PA between adjacent polishing tracks PS of the polishing path P is achieved or traversed, as indicated in FIG. 3. The distance PA is thus especially preferably kept at least essentially constant. However, alternatively, the distance PA can vary, in particular depending on the workpiece radius, in which the center of the contact surface A is (just) located.

Especially preferably, the diameter AD of the contact surface A is greater by at least the factor 10 or 20 than the spiral distance or distance PA between adjacent polishing tracks PS.

The tool 3 preferably rotates opposite to the workpiece 2. However, rotation in the same direction is also possible.

The tool 3 preferably rotates (much) faster than the workpiece 2.

To achieve a dwell time of the tool 3 or the contact surface A that is similar or if applicable as identical as possible over a surface area of the surface 2A, in the case of the uniform rotational speed of the tool 3, the rotational speed of the workpiece 2, thus consequently also the speed of movement of the workpiece 2 along the tool path W starting from the edge 2C to the center 2B, is increased and then decreased again to the edge.

As an alternative or in addition, the rotational speed of the workpiece 2 can also be varied during a rotation in particular depending on the rotation position, the diameter AD of the contact surface A, the contact pressure of the tool 3 on the workpiece 2, the indentation depth E of the polishing surface 9 and/or the profile of the workpiece 2, in order to achieve an especially uniform material removal and/or a desired polishing result. This makes in particular high-precision polishing processing possible.

Especially preferably, the device 1 is designed in such a way and/or the proposed method is implemented in such a way that the size or the diameter AD of the contact surface A is kept at least essentially constant during the polishing process. This is conducive to a uniform and/or defined material removal.

The size or the diameter AD of the contact surface A is determined in particular also by the indentation depth E of the polishing surface 9 that is schematically indicated in FIG. 4 by corresponding advancing of the tool 3 during the polishing process, but it also depends on the surface form of the workpiece 2, in particular the respective curvature, and on the curvature of the polishing surface 9.

By varying the advancing of the tool 3 during the polishing process, the indentation depth E of the polishing surface 9 and thus also the size or diameter AD of the contact surface A is varied accordingly.

Especially preferably, the indentation depth E of the polishing surface 9 is varied by corresponding advancing of the tool 3 during a polishing process so that in particular even in the case of varying curvatures of the surface 2A that is to be polished, especially preferably in the case of an aspherical surface 2A, an at least essentially constant diameter AD of the contact surface A is achieved. This is conducive to a uniform and/or defined material removal throughout the entire polishing process.

As an alternative, it can also be provided that the diameter AD of the contact surface A decreases starting from the edge 2C to the center 2B and increases in the opposite direction.

The speed of the C-axis, thus the rotational speed of the workpiece 2, is preferably derived from calculated dwell times of the contact surface A over certain partial surfaces of the surface 2A that is to be polished.

Preferably, for correcting local rotationally asymmetrical errors of the surface 2A that is to be polished, the track speed or rotational speed of the workpiece 2 is changed within a rotation. In this way, in particular within one rotation, different polishing or dwell times, depending on the necessary correction of errors, can be achieved.

The speed of the X-axis is adapted in particular so that per rotation, the desired constant spiral distance or distance PA between adjacent polishing tracks PS remains constant. Consequently, the feed in the X-direction is then linked directly to the speed or number of rotations of the C-axis or vice versa.

Preferably, the optimum dwell time of the tool 3 or the contact surface A is determined in advance by means of a simulation in local areas on the surface 2A that is to be polished. Then, the corresponding track positions and track speeds are determined from the calculated local dwell times.

The optimum indentation depth E of the polishing surface 9 or the advancing of the tool 3 to the workpiece 2 is optimally determined depending on the tool 3 and the geometry of the surface 2 that is to be polished, in particular by means of corresponding calculations, estimates and/or measurements, wherein the indentation depth E during the polishing process is adapted in particular so that the diameter AD of the contact surface 2A remains as constant as possible.

The proposed polishing tool 3 is distinguished in particular by a cap 6 or a cap design with defined springing and damping properties. Thus, the size of the contact surface A can be influenced very precisely by the indentation depth E.

The indentation depth E is preferably more than 0.1 mm and/or less than 0.8 mm.

The size or the diameter AD of the contact surface A is preferably more than 1 mm, in particular more than 3 mm, and/or less than 25 mm, in particular less than 15 or 10 mm.

Especially preferably, a zonal polishing of the workpiece 2 is carried out. "Zonal" is to be understood in that the contact surface A is significantly smaller in comparison to the surface 2A of the workpiece 2 that is to be polished, in particular compared to the radial extension of the workpiece 2. Especially preferably, the mean or maximum diameter AD of the contact surface A is significantly smaller than the mean or maximum radius of the workpiece 2. Especially preferably, the mean or maximum radius of the workpiece 2 is larger by at least a factor 2, 3 or 5 than the mean or maximum diameter AD of the contact surface A.

In supplementation, during polishing, additional parameters can be taken into consideration, as explained in particular in German Patent Application DE 10 2009 004 787 A1 and corresponding U.S. Pat. No. 8,727,834 B2, which is hereby incorporated by reference as a supplemental disclosure.

The device 1 in particular also has a feed for polishing agents, not shown, as is common in polishing machines, so that the polishing agents can be fed in a desirable way during polishing.

The proposed tool 3, the proposed device 1 and/or the proposed method can be used in particular for polishing precision optics or aspherical surfaces or other optical workpieces, wherein the surface shape can preferably be measured before polishing and thus a desired surface shape can be achieved by the polishing. This is also referred to as correction polishing.

The polishing can be done in particular with an accuracy of 10 to 100 nm.

Tools 3 with smaller radii of curvature of the polishing surface 9, in particular with radii of curvature of less than 100 mm, especially preferably less than 50 mm, are preferably used for purposes of correction.

Tools 3 with larger radii of curvature of the polishing surface 9, in particular of up to 1,000 mm, are preferably used for pre-polishing.

After the optimum pre-polishing, preferably measuring of the surface 2A that is to be processed and then the correction polishing are carried out.

The proposed device 1 and the proposed method can be used in principle both for pre-polishing and for correction polishing.

Individual aspects and features of this invention can be implemented independently of one another, but also in any combination.

The invention claimed is:

1. A method for polishing of a surface of an optical workpiece, comprising:

swiveling or advancing a tool with a curved polishing surface relative to the workpiece, so that a contact portion of the polishing surface of the tool is pressed partially against the workpiece to be polished, moving the tool over a full diameter of the surface to be polished and through a center of the surface to be polished, rotating the workpiece, increasing a rotational speed of the workpiece when the tool is moved towards the center of the surface and decreasing the rotational speed of the workpiece when the tool is moved away from the center, and rotating the tool at a constant rotational speed which is faster than a maximum rotational speed of the workpiece, wherein the moving of the tool across the diameter of the surface combined together with the rotating of the workpiece results in the contact portion traversing a spiral polishing path.

2. The method according to claim 1, wherein the polishing surface is pressed partially against the workpiece to be polished to a degree producing an indentation of the contact portion, and wherein a diameter of the contact portion is kept at least essentially constant by variation of a depth of the indentation.

3. The method according to claim 1, wherein a diameter of the contact portion decreases when moving towards the center of the surface that is to be polished and increases when moving away from the center.

4. The method according to claim 1, wherein the diameter of the contact portion is smaller than the surface of the workpiece.

5. The method according to claim 1, wherein the rotational speed of the workpiece during rotation is varied depending on at least one of a rotating position of the workpiece, a locally desired dwell time, or a profile of the workpiece.

6. The method according to claim 1, further comprising keeping of a diameter of the contact portion at least essentially constant during the polishing of the workpiece.

7. The method according to claim 1, wherein the polishing surface is pressed partially against the workpiece to be polished to a degree producing an indentation of the contact portion, and wherein an indentation depth of the contact portion is varied by advancing the tool during the polishing of the workpiece.

8. The method according to claim 1, further comprising keeping a distance between adjacent tracks of the spiral polishing path at least essentially constant.

9. The method according to claim 7, wherein the degree of said indenting is varied by feedback controlled during advancing of the tool relative to the workpiece during the polishing process depending on the radial position of the contact portion on the workpiece.

10. The method according to claim 7, wherein a diameter of the contact portion is kept at least essentially constant by variation of the indentation depth.

11. The method according to claim 7, wherein a diameter of the contact portion decreases when moving towards the center of the surface that is to be polished and increases in the opposite direction.

12. The method according to claim 7, wherein the rotational speed of the workpiece increases starting from polishing on the edge to the center of the surface and decreases when moving away from the center.

13. The method according to claim 7, wherein the moving of the tool across the diameter of the surface combined together with the rotating of the workpiece results in the contact portion traversing a spiral polishing path relative to the workpiece.

14. The method according to claim 7, wherein the diameter of the contact portion is smaller than the surface of the workpiece, and wherein the depth of the indentation is varied depending on at least one of a desired contact pressure of the tool on the workpiece or a profile of the workpiece.

15. The method according to claim 1, wherein the rotational speed of the workpiece is changed within one rotation.

* * * * *